United States Patent [19]

Miller et al.

[11] 4,271,970

[45] Jun. 9, 1981

[54] PEDESTAL CRANE

[75] Inventors: William H. Miller, Flowing Springs Rd., Birchrunville, Pa. 19421; Jesse T. Grubb, Devault, Pa.

[73] Assignee: William H. Miller, Birchrunville, Pa.

[21] Appl. No.: 870,310

[22] Filed: Jan. 18, 1978

[51] Int. Cl.[3] ..... B66C 23/06; B63B 27/00

[52] U.S. Cl. ..... 212/146; 212/190; 212/232; 212/192; 212/266; 414/697; 414/140; 280/5 A

[58] Field of Search ..... 212/3, 8 R, 8 A, 8 B, 212/35 R, 35 H, 46 R, 54, 58 R, 59 R, 61-65, 66-70, 146, 190, 192, 223, 232, 237-238, 266; 280/5 A, 5 R, 5 H, 5 F; 214/140, 12-15 R; 414/697, 137-145

[56] References Cited

U.S. PATENT DOCUMENTS

| | | | |
|---|---|---|---|
| 2,787,383 | 4/1957 | Antos et al. | 212/35 HC |
| 2,841,960 | 7/1958 | Holan et al. | 212/35 HC |
| 2,916,162 | 12/1959 | Gercke | 212/58 A |
| 3,559,817 | 2/1971 | Brown | 212/35 R |
| 3,591,022 | 7/1971 | Polyakov et al. | 212/35 X |
| 3,850,473 | 3/1975 | Huber | 214/140 |

FOREIGN PATENT DOCUMENTS

| | | | |
|---|---|---|---|
| 2126168 | 12/1972 | Fed. Rep. of Germany | 280/5 R |

*Primary Examiner*—Stephen G. Kunin
*Assistant Examiner*—R. B. Johnson
*Attorney, Agent, or Firm*—Seidel, Gonda, Goldhammer & Panitch

[57] ABSTRACT

A pedestal crane of compact construction having a small turning radius is provided for use on board ships and/or off-shore drilling platforms. The crane has a dynamic load compensator so that it may absorb shock loads due to waves on the surrounding body of water. The crane mast includes upright walls supporting a fuel tank and hydraulic tank with the prime mover being between said walls.

8 Claims, 6 Drawing Figures

PEDESTAL CRANE

BACKGROUND

A conventional boom on a crane is designed for compression. It is important for pedestal cranes on off-shore drilling platforms and ships that the boom be designed as a flexural member so that it can take dynamic loads like a fishing rod. In this manner, the crane must absorb sudden shock loads due to the waves. Unless the boom is designed as a flexural member, it is necessary to rely on the skill of the operator or some other intricate system to signal the operator when the boom may be raised.

On board ship and off-shore drilling platforms, space is at a premium. Hence, it is essential that the components of the crane be orientated in a manner so as to be as compact as possible with the smallest possible turning radius. Orientating components to achieve compactness creates problems not ordinarily present on a conventional crane. The crane of the present invention presents a solution to all of said problems.

SUMMARY OF THE INVENTION

The present invention is directed to a pedestal crane which is adapted to be used on board ship and/or off-shore drilling platforms. The crane includes a base which supports a platform for 360° rotation. A mast is rigidly connected to the platform and includes a pair of upright walls. A prime mover is supported adjacent the mast between the upright walls of the mast adjacent one end thereof.

A first tank for containing fuel for the prime mover and a second tank containing a hydraulic fluid are supported by the mast above the elevation of the platform, and preferably said tanks are an integral part of the mast. At least one upright cylinder containing a piston therein is pivotably connected at its lower end to the mast and is disposed between the walls adjacent the other end thereof. A boom has one end pivotably connected to the upper end portion of the mast. A piston rod extending from said cylinder is pivotably connected to the boom.

An operator cab is supported by the platform under said boom. Said cylinder is between said cab and said prime mover. The cab is provided with controls for operating the prime mover and a winch. At least one winch is provided on the boom. A cable extends from said winch to a pulley on the free end of the boom. Hydraulic circuitry is provided including a pump communicating with the second tank and is driven by the prime mover for pumping hydraulic fluid from the second tank to said cylinder for elevating the boom.

In a specific preferred embodiment to the present invention, the boom is constructed so that it may take dynamic loads such as a fishing rod. In this regard, the boom includes an accumulator for absorbing dynamic loads on the cable. This provides the advantage of compensating for shock loads without any intricate circuitry and for minimizing the skill needed by the operator.

It is an object of the present invention to provide a pedestal crane which is compact, has a turning radius of less than 8 feet and which may compensate for dynamic loads.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown in FIG. 1 a pedestal crane in accordance with the present invention designated generally as 10 and particularly adapted for use on ships and/or off-shore drilling platforms.

Figure 1:
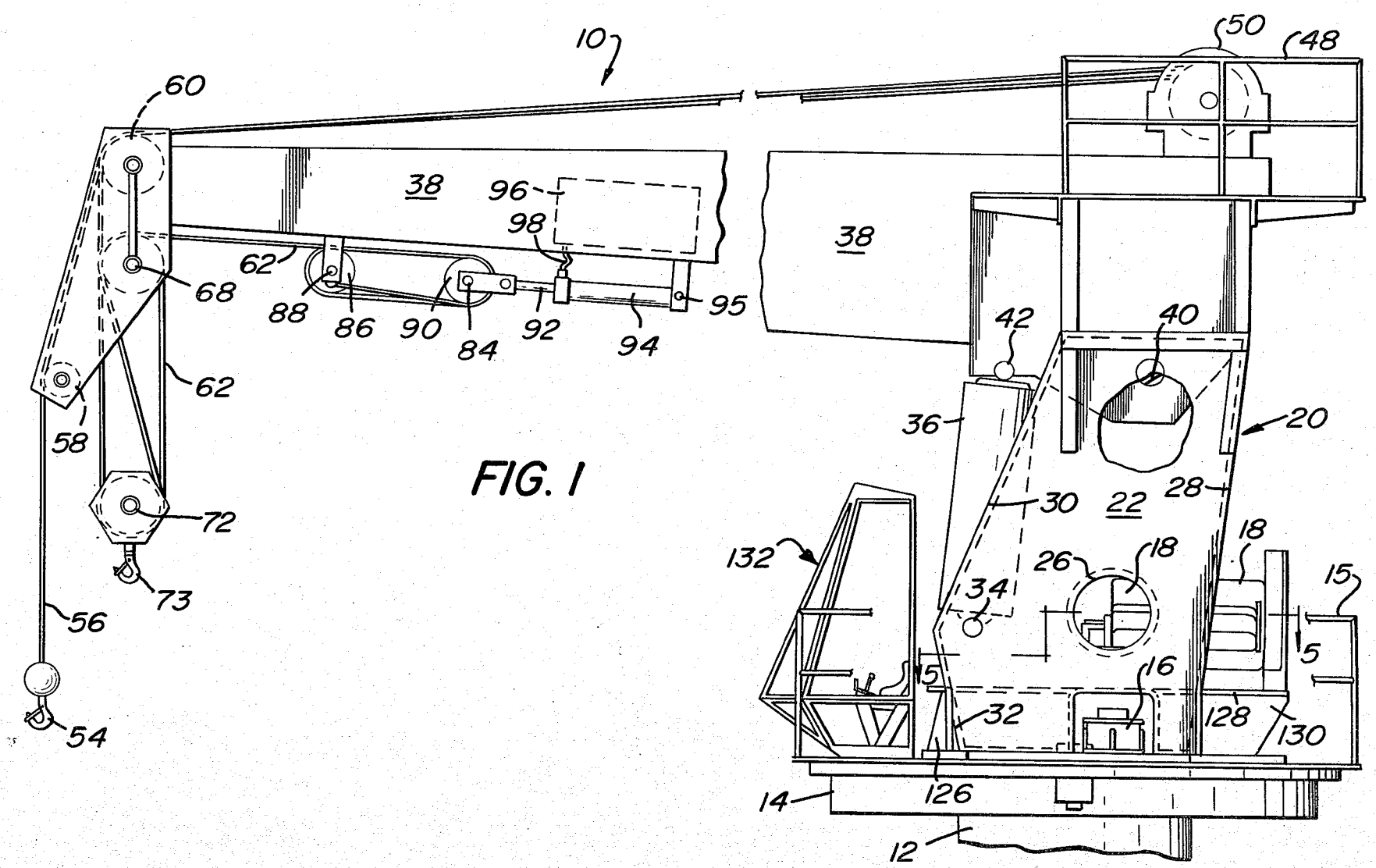
FIG. 1 is a side elevation view of a crane in accordance with the present invention.
Figure 2:
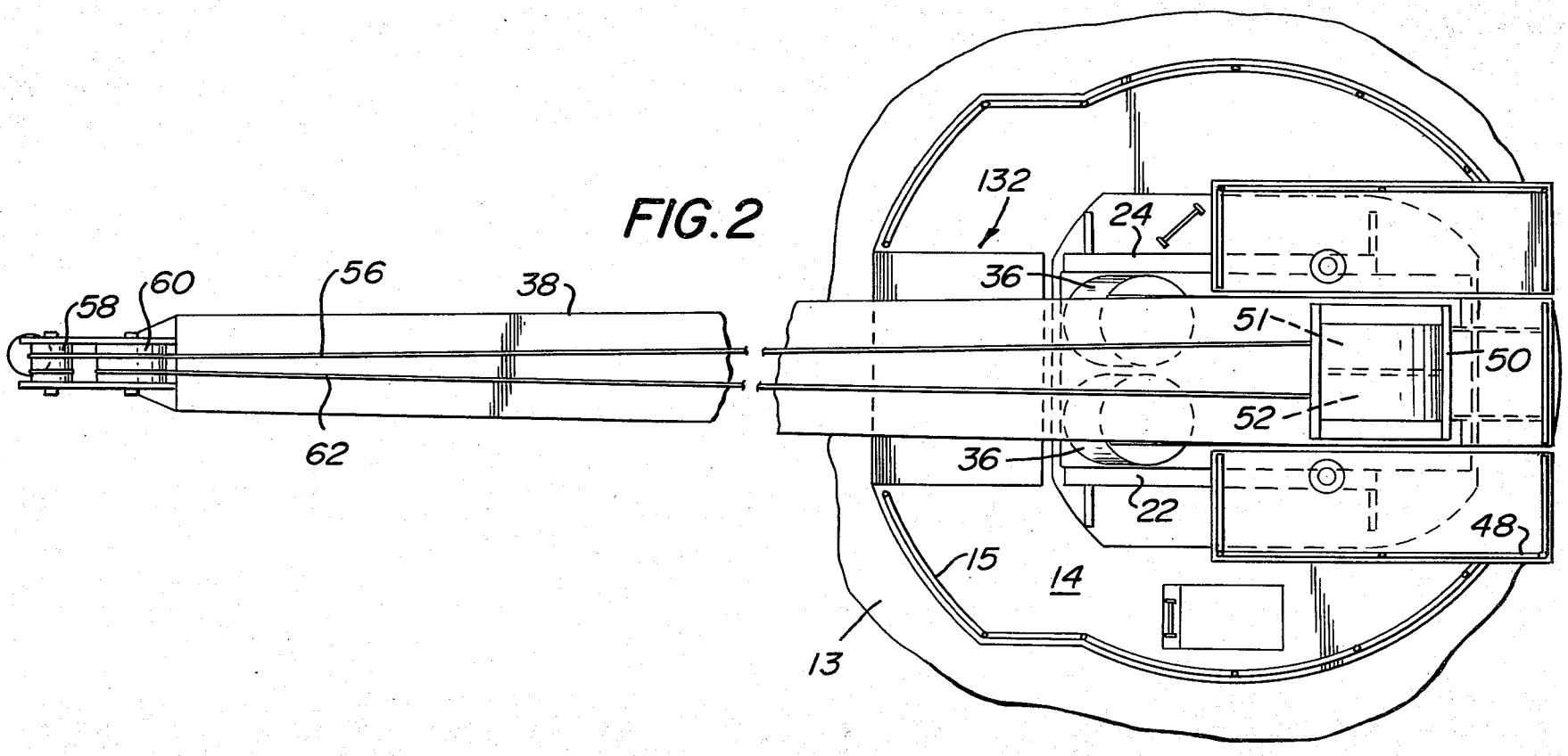
FIG. 2 is a top plan view of the crane shown in FIG. 1.

The crane 10 includes a base 12 to be fixedly secured to a support surface 13 on a ship, off-shore drilling platform or the like. The base 12 rotatably supports platform 14 for rotation of the latter through 360°. Conventional bearings and pinion drive associated with the base 12 and platform 14 are not shown. The pinion is driven by a gear reducer 16 supported by platform 14. A guard rail 15 circumscribes the platform 14.

A mast 20 is supported by the platform 14 and extends upwardly therefrom. A prime mover 18 is supported between upright walls 22 and above the elevation of platform 14. The prime mover 18 is adjacent one end of the walls 22, 24 of the mast 20. Prime mover 18 is preferably an air cooled 50 horsepower diesel engine.

The walls 22, 24 of the mast 20 are preferably in the form of an irregular pentagon with each of the walls having a hole 26 therethrough. The holes 26 provide for transverse air flow for cooling the prime mover 18. The walls 22 are defined by a rear edge 28 which is the longest side of the irregular pentagon, an upwardly converging front edge 30 and a downwardly converging front edge 32 which is the shortest side of the irregular pentagon. The upper edge of the walls 22 is shorter than the lower edge of the walls.

At least one and preferably two hydraulic cylinders 36 are pivotably connected to the walls 22, 24 by axle 34 adjacent the inner section of front edges 30, 32. A boom 38 which may be of the telescoping type has one end provided with a depending portion disposed between the upper ends of walls 22, 24 and pivotably connected thereto by axle 40. When the boom 38 is in its lowermost position as shown in FIG. 1, axles 40 and 42 are at about the same elevation. Pivot axle 42 on the boom 38 hingedly connected to a piston rod extending from the cylinders 36.

A first tank 44 containing diesel fuel for the prime mover 18 is supported by one of the walls, namely wall 22 of the mast 20. A second tank 46 containing hydraulic fluid is supported by the other wall of the mast, namely wall 24. To facilitate cooling of the tanks 44, 46 so that their contents is about 130° F. or below, the tanks may be provided with fins. The tanks 44, 46 are preferably provided by making the walls 22, 24 hollow. If desired, the tanks 44, 46 may be discrete tanks supported on the upper ends of the walls 22, 24.

A guard rail 48 is supported by the mast 20 to facilitate operator access to winches connected to the adjacent end of the boom 38. The boom 38 is provided with a winch housing 50. Winches 51 and 52 are provided within housing 50. If desired, only one cable and winch may be utilized. As illustrated, the boom is provided with dual winches and dual cables.

A hook 54 is connected to a free end of cable 56. Cable 56 extends around pulleys 58, 60 on the free end of the boom 38. From pulley 60, the cable 56 extends to winch 51 which provides for a high speed, low load cable system.

Figure 3:
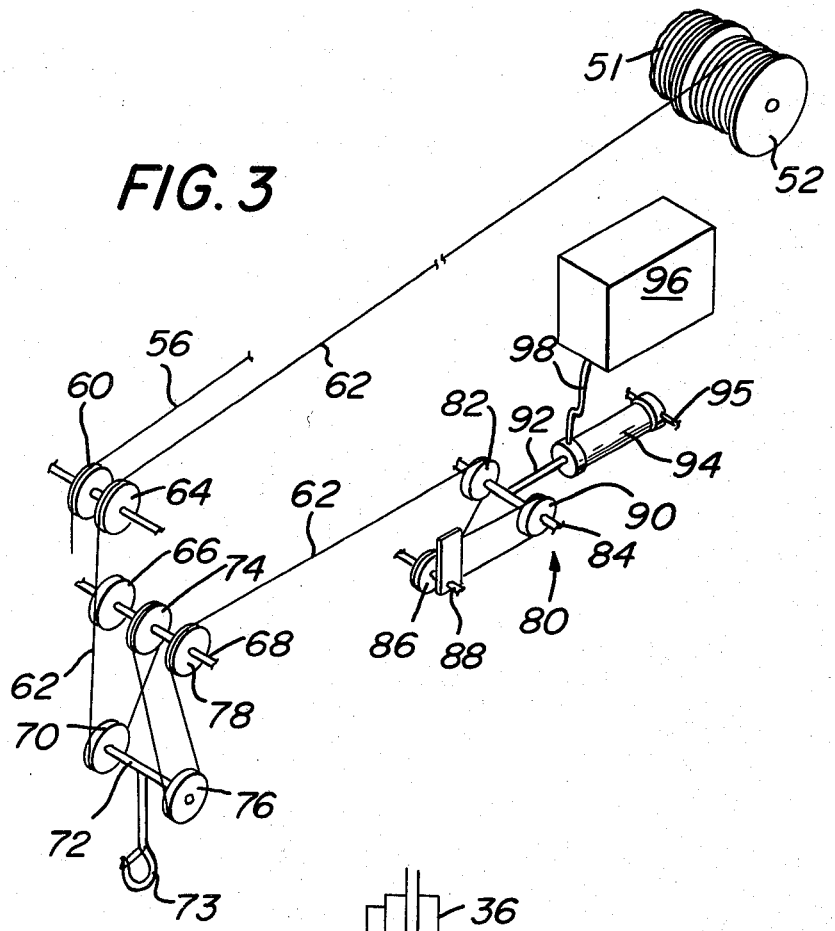
FIG. 3 is a schematic perspective view of the cable system used on the crane shown in FIG. 1.

A low speed, high load cable system is provided including winch 52 from which extends a cable 62. See FIG. 3. The cable 62 extends around a pulley 64 which is coaxial with pulley 60. From pulley 64, the cable 62 extends around pulley 66 on shaft 68 supported by boom 38. From pulley 66, the cable 62 extends downwardly around a pulley 70 on shaft 72 associated with a hook 73. From pulley 70, the cable 62 returns upwardly to pulley 74 on shaft 68, and downwardly to pulley 76 on shaft 72, and then upwardly to pulley 78 on shaft 68.

From pulley 78, the cable 62 extends rearwardly along the boom to a dynamic load compensator designated generally as 80. The compensator 80 includes pulleys 82 and 90 on shaft 84 and a pulley 86 on shaft 88. Shaft 88 is rotatably supported by the boom 38 for rotation about a horizontal axis. Cable 62 extends around pulley 82, then around pulley 86, then around pulley 90, and then is anchored to the support bracket for shaft 88.

Shaft 84 and the pulleys 82, 90 thereon are connected to one end of a piston rod 92. The piston rod 92 is connected to a piston within cylinder 94. One end of cylinder 94 is pivotably connected by shaft 95 by a bracket depending from the boom 38. An accumulator 96 is supported within or on a side of the boom 38.

The accumulator 96 is preferably of the pressurized type containing an inflatable chamber. The inflatable chamber communicates with one end of cylinder 94. The fluid in the inflatable chamber biases the piston in cylinder 94 from left to right in FIG. 1. Sudden shock loads on hook 73 will cause the piston in cylinder 94 to move from right to left in FIG. 1 thereby causing the hydraulic fluid to be transferred from cylinder 94 into accumulator 96 by way of conduit 98. When that occurs, the piston rod 92, shaft 84 supported thereby, and pulleys 82, 90 move from right to left in FIG. 1.

Figure 4:
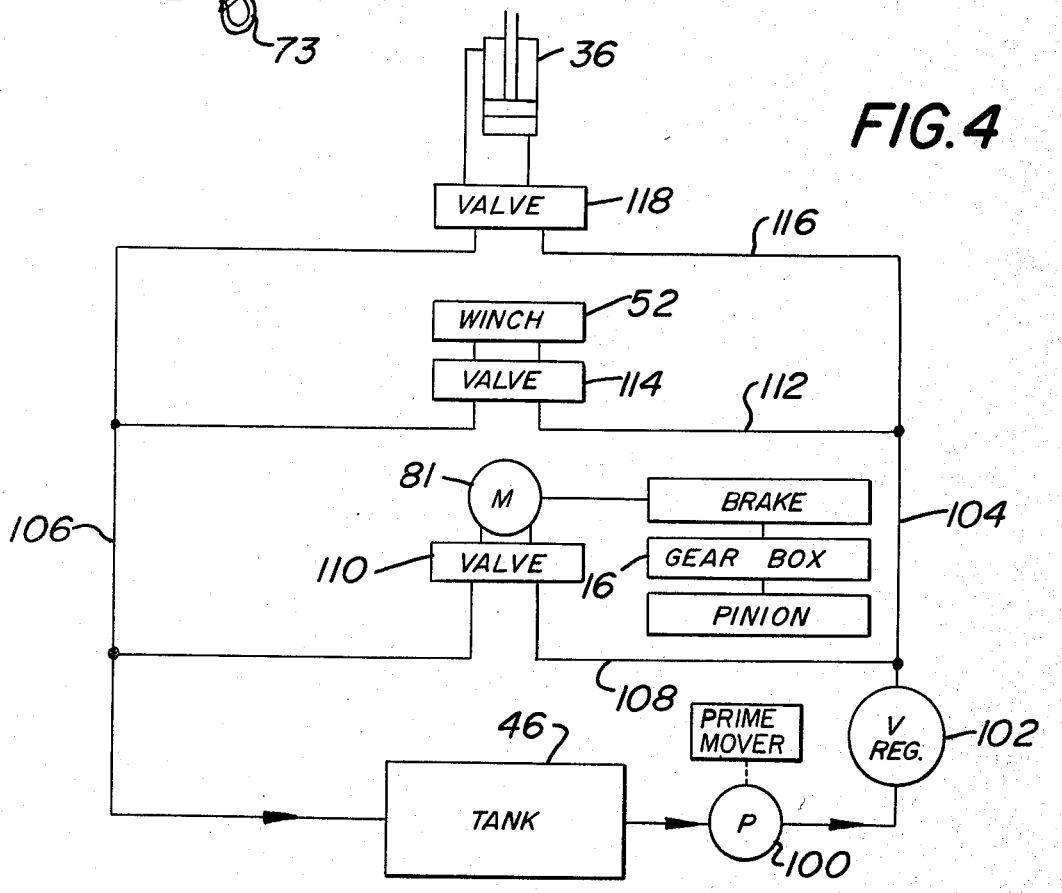
FIG. 4 is a diagrammatic view of circuitry for the hydraulic system.

Referring to FIG. 4, there is shown in a diagrammatic manner hydraulic circuitry associated with the crane 10. Tank 46 contains the hydraulic fluid which is utilized to operate the crane 10. A pump 100 is driven by the prime mover 18 and has its inlet connected to tank 46 and its outlet connected to conduit 104 containing a pressure regulating valve 102. The various mechanisms and valves are connected across the supply conduit 104 and return conduit 106.

Conduit 108 extends across conduits 104, 106 and includes a solenoid operated valve 110. Valve 110 controls the supply and exhaust of hydraulic fluid to the hydraulic motor 81. The motor 81 in turn operates a hydraulic brake which controls the gear reducer 16, which is sometimes called a gear box which in turn operates the pinion for rotating platform 14 with respect to base 12.

A conduit 112 extends across conduits 104, 106 and contains a solenoid operated valve 114. Valve 114 controls supply and exhaust of hydraulic fluid to the hydraulic winch 52. A similar valve, not shown, is provided for the winch 51. A conduit 116 extends across conduits 104, 106 and contains a solenoid operated valve 118. Valve 118 controls supply and exhaust of hydraulic fluid to the cylinders 36.

Figure 5:
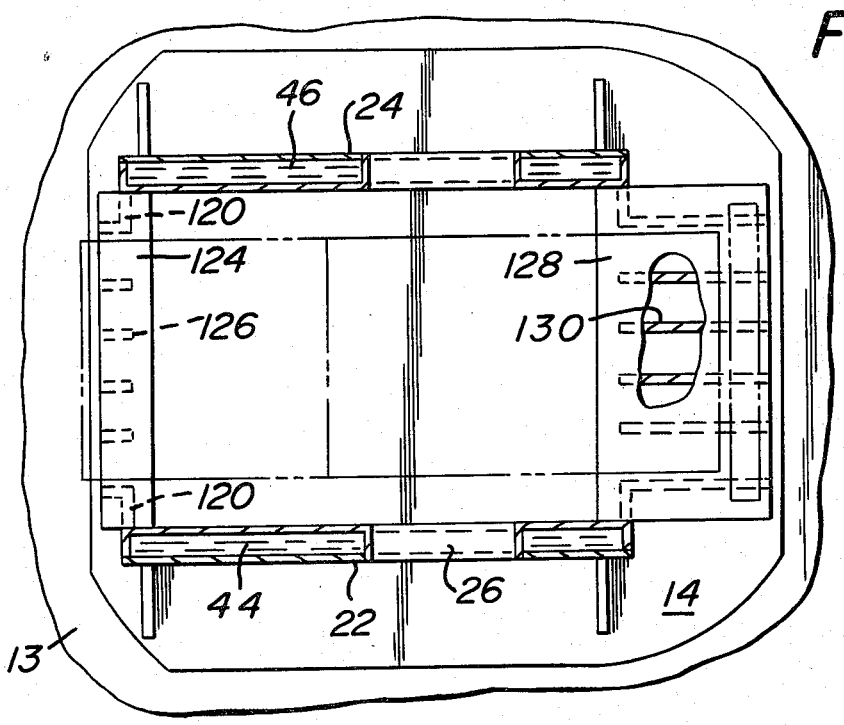
FIG. 5 is a sectional view taken along the line 5—5 in FIG. 1 to show the connection between the mast and the platform.
Figure 6:
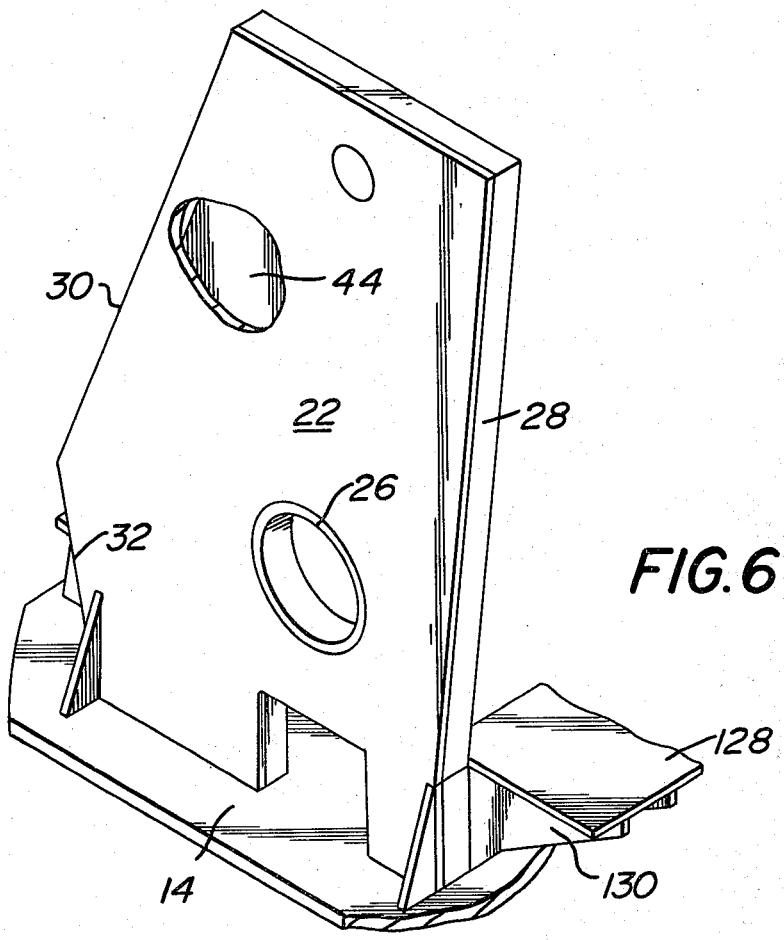
FIG. 6 is a perspective view of a portion of the mast of the present invention.

The entire periphery of the mast 20 is fixedly secured to the platform 14. See FIG. 5. The front end of each wall 22, 24 is connected by an angle iron 120 welded to a horizontal plate 124. Angle irons 120 are welded at their lower ends to platform 14. Plate 124 is welded to parallel struts 126 which are welded to platform 14. The rear end of the walls 22, 24 are similarly connected to angle irons which jam platform 14 to a plate 128. Plate 128 is welded to parallel struts 130 which are welded to platform 14. Prime mover 18 is supported by plate 128.

An operator cab 132 is provided on platform 14 below the boom 38. The controls for the winches, prime mover, etc. are in cab 132.

The present invention may be embodied in other specific forms without departing from the spirit or essential attributes thereof and, accordingly, reference should be made to the appended claims, rather than to the foregoing specification as indicating the scope of the invention.

It is claimed:

1. A pedestal crane which is compact and constructed so as to have a turning radius less than about 8 feet comprising a base, a platform above and supported by the base for 360 degree rotation about a vertical axis, a mast rigidly connected to an upper surface on said platform for rotation therewith, means coupled to the platform for rotating said platform and mast about said axis, said mast including a pair of upright walls, a prime mover disposed between said walls adjacent one end thereof, a first tank for containing fuel for said prime mover, a second tank for containing hydraulic fluid, at least one upright cylinder containing a piston therein, the lower end of said cylinder being pivotably connected to said mast and being between said walls adjacent the other end thereof, a boom having one end pivotably connected to the upper end portion of said mast, said piston having a piston rod pivotably connected to said boom, a winch on said boom adjacent said one end thereof, a cable extending from said winch to a pulley on the other end of said boom, an operator cab supported beneath said boom for rotation with said platform, said cylinder being between said cab and said prime mover, said cab having controls for operating said prime mover and winch, a guard rail adjacent the periphery of said platform, and a dynamic load compensator supported by said boom between its ends for absorbing dynamic shocks on said cable, said load compensator including a fluid accumulator supported by said boom between its ends, said accumulator being coupled to said cable for directly controlling the effective length of said cable as a function of dynamic shock loads on said cable.

2. A crane in accordance with claim 1 wherein said upright walls having an opening therein, said openings being aligned and being at an elevation corresponding generally a portion of said prime mover to facilitate air cooling said prime mover.

3. A crane in accordance with claim 1 wherein said upright walls are hollow, one of said hollow upright walls having said first tank therewithin, the other of said hollow upright walls having said second tank therewithin.

4. A pedestal crane comprising a base, a platform supported on the upper surface of said base for 360 degrees rotation, a prime mover on said platform for rotation with the platform relative to the base, a hollow mast rigidly connected to an upper surface on said platform, means coupled to the platform for rotating said platform and mast about a vertical axis, said mast including first and second sets of upright walls, said first set of upright walls defining a first tank therewithin for containing fuel for said prime mover, said second set of upright walls defining a second tank for containing hydraulic fluid, said prime mover being disposed between said first and second sets of upright walls, at least one upright cylinder containing a piston therein, a boom having one end pivotably connected to the upper end portion of said mast, said piston having a piston rod pivotably connected to said boom, circuitry for controlling flow of hydraulic fluid from said second tank to said cylinder, a winch on said boom adjacent said one end thereof, a cable extending from said winch to a pulley on a free end of said boom, and a dynamic load compensator supported by said boom between its ends for absorbing dynamic shocks on said cable, said load compensator including a fluid accumulator supported by said boom between its ends, said compensator directly controlling the effective length of said cable as a function of dynamic shock loads on said cable.

5. A crane in accordance with claim 4 wherein said upright walls having an opening therein, said openings being aligned and being at an elevation corresponding generally a portion of said prime mover to facilitate air cooling said prime mover.

6. A crane in accordance with claim 4 including at least one pulley around which said cable extends, said one pulley being connected to a piston rod extending from a cylinder, said cylinder being in communication with said accumulator in a manner so that shock loads on said cable transfers fluid under pressure from said last-mentioned cylinder to said accumulator.

7. A crane in accordance with claim 4 wherein said cylinder is pivotably connected to said mast adjacent an apex defined by the intersection of a first front edge of said mast which is angled upwardly and away from the free end of the boom and a second edge which is angled downwardly and away from the free end of the boom.

8. A crane in accordance with claim 4 wherein said cable is connected to said compensator by way of a horizontally disposed shaft which moves upwardly and downwardly with the cable and contains only a pair of pulleys, said cable extending around each of said pulleys.

* * * * *